US007128595B2

(12) United States Patent
Boutros

(10) Patent No.: US 7,128,595 B2
(45) Date of Patent: Oct. 31, 2006

(54) ELECTRICAL CONNECTOR WITH POSITIVE LOCK

(75) Inventor: Kamal S. Boutros, Richmond Hill (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/086,378

(22) Filed: Mar. 23, 2005

(65) Prior Publication Data

US 2006/0216991 A1 Sep. 28, 2006

(51) Int. Cl.
*H01R 13/627* (2006.01)

(52) U.S. Cl. ..... 439/358; 439/607

(58) Field of Classification Search ..... 439/350, 439/354, 357, 358 I, 607
See application file for complete search history.

(56) References Cited

U.S. PATENT DOCUMENTS 6,350,159 B1 * 2/2002 Wu ..... 439/680
6,428,341 B1 * 8/2002 Kinezuka et al. ..... 439/358
6,491,538 B1 * 12/2002 Fenger ..... 439/358
6,579,113 B1 * 6/2003 Kodama ..... 439/358
6,592,392 B1 * 7/2003 Po-Heng ..... 439/358
2002/0064997 A1 * 5/2002 Noguchi et al. ..... 439/607

* cited by examiner

*Primary Examiner*—Thanh-Tam Le
(74) *Attorney, Agent, or Firm*—Blank Rome LLP

(57) ABSTRACT

An electrical connector including a shell having a inner area supporting a contact member adapted to mate with a contact of another connector. The shell includes a wall having at least one locking opening and a flexible extension. A locking member includes first and second ends, the first end including at least one locking tab received in the locking opening and extending into the inner area of the shell in a locked position, and the second end being coupled to the extension of the shell. The locking member is moveable to an unlocked position in a first direction away from the wall of the shell and the extension is moveable in a second direction opposite the first direction, so that no portion of the locking tab extends into the inner area of the shell.

18 Claims, 2 Drawing Sheets

ELECTRICAL CONNECTOR WITH POSITIVE LOCK

FIELD OF THE INVENTION

The present invention relates to an electrical connector with a positive locking feature for releasably locking the electrical connector to another mating electrical connector.

BACKGROUND OF THE INVENTION

Conventional electrical connectors for data transmission, such as universal serial bus (USB) connectors, include two mating parts, a plug and a receptacle. The receptacle receives the plug thereby connecting their respective electrical contacts of the plug and receptacle. Springs arms typically are provided in the receptacle body to grip the plug when it is inserted into the receptacle. However, these spring arms often fail to sufficiently hold the plug in the receptacle resulting in inadvertent separation of the plug from the receptacle and loss of data transmission.

SUMMARY OF THE INVENTION

Accordingly, an object of the present invention is to provide an electrical connector with a positive locking feature that releaseably locks the connector with a mating connector and prevents inadvertent disconnection of the two connectors.

The above object is basically attained by an electrical connector including a shell having a inner area supporting a contact adapted to mate with a contact of another connector. The shell includes a wall having at least one locking opening and a flexible extension. A locking member includes first and second ends, the first end including at least one locking tab received in the locking opening and extending into the inner area of the shell in a locked position, and the second end being coupled to the extension of the shell. The locking member is moveable to an unlocked position in a first direction away from the wall of the shell and the extension is moveable in a second direction opposite the first direction, so that no portion of the locking tab extends into the inner area of the shell in the unlocked position.

The above object is also attained by an electrical connector having a shell with an inner area supporting a contact mateable with a contact of another connector. The shell includes a wall having at least one locking opening and a flexible extension. A locking member is moveable between locked and unlocked positions and has first and second ends. The first end includes at least one locking tab, and the second end is coupled to the extension of the shell. In the locked position the locking tab is received in the locking opening of the shell and in a corresponding locking opening of the other connector, and the locking member is moveable to the unlocked position in a first direction away from the wall of the shell and the extension of the shell is moveable in a second direction opposite the first direction, so that no portion of the locking tab extends into the locking opening of the second connector.

The object is also attained by a method for mating first and second electrical connectors with the first electrical connector including a locking member having a locking tab received in an opening of a shell of the electrical connector and a flexible extension extending from the shell. The method includes the steps of slideably inserting a terminal end of the second connector into an inner area of the first connector, engaging the terminal end of the second connector with the locking tab of the locking member of the first connector to move the locking tab in a first direction out of the inner area of the first connector and substantially simultaneously moving the flexible extension in a second direction opposite the first direction, and dropping the locking tab in an opening in the second connector that aligns with the opening of the first connector, thereby releaseably locking the first and second connectors together.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1–6, an electrical connector 100 in accordance with the present invention includes a positive locking feature to releasably lock the electrical connector 100, such as a receptacle, with a mating electrical connector 102, such as a plug. In general, the positive locking feature of the electrical connector 100 includes a flexible locking member 104 coupled to the connector 100 that releasably engages the mating connector 102 when the two connectors 100 and 102 are mated. The two connectors 100 and 102 can only be disconnected by releasing the locking member 104 (unless excessive force is used to separate the connectors), thereby preventing inadvertent separation of the two connectors 100 and 102.

Figure 1:
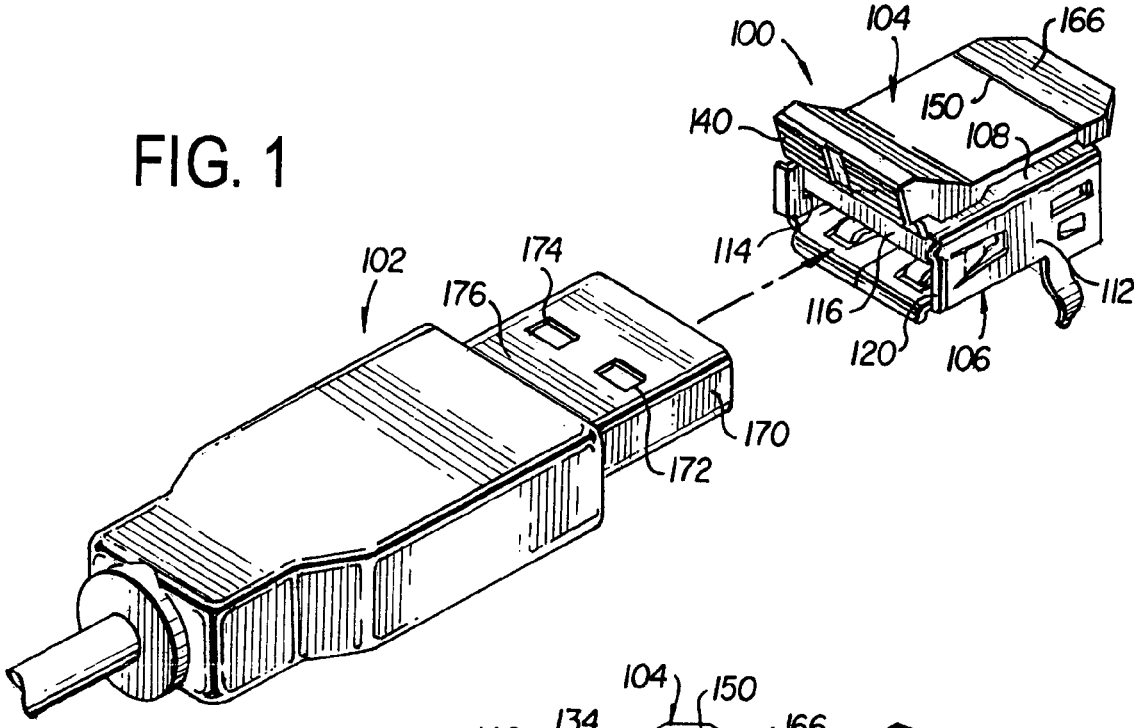
FIG. 1 is a perspective view of an electrical connector in accordance with the present invention, showing the electrical connector being mated with another connector.
Figure 2:
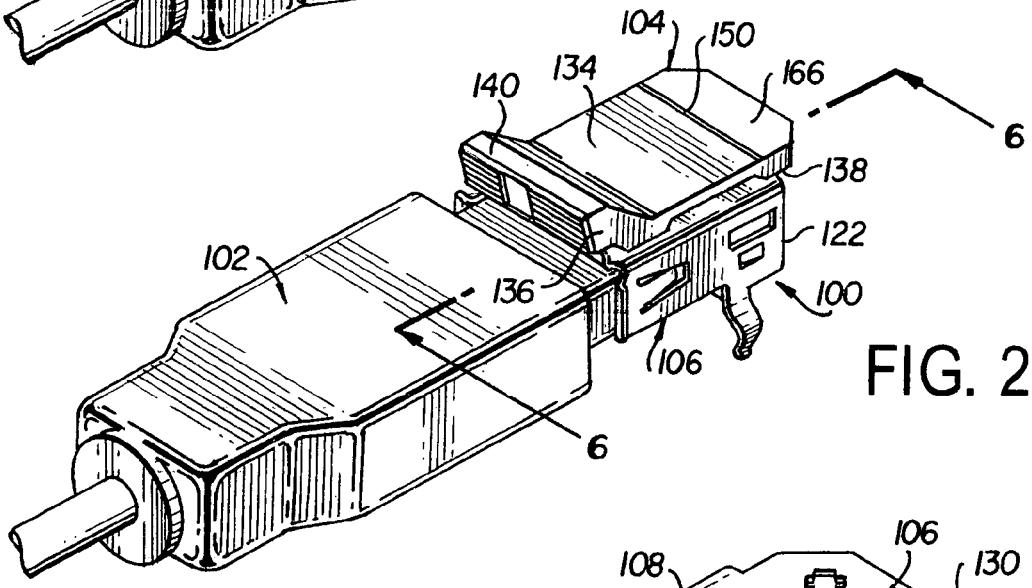
FIG. 2 is a perspective view of the electrical connector illustrated in FIG. 1, showing the electrical connector mated with the other connector.
Figure 3:
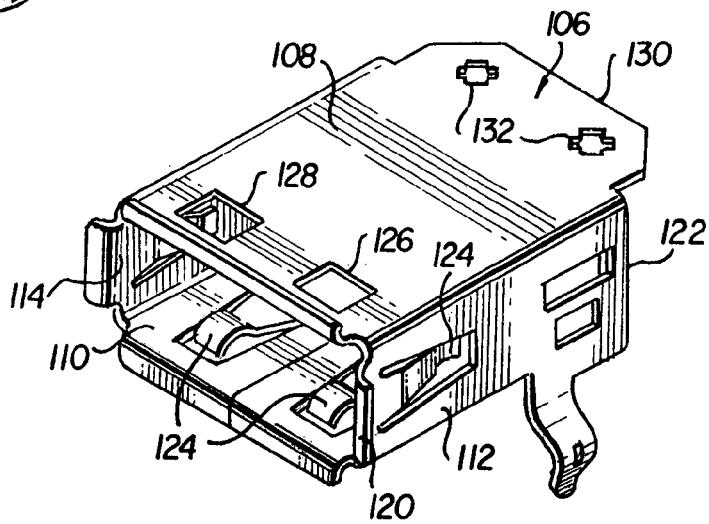
FIG. 3 is a perspective view of a shell of the electrical connector illustrated in FIGS. 1 and 2.

Connector 100 includes a shell 106 with first and second opposite main walls 108 and 110, and sidewalls 112 extending between first and second main walls 108 and 110, as best seen in FIG. 3. Main walls 108 and 110 and sidewalls 112 define an inner area 114 of connector 100 that supports a contact 116 for mating with a contact 118 (FIGS. 5 and 6) of the mating connector 102. Shell 106 includes opposite first and second ends 120 and 122 and the first end 120 is open to receive the mating connector 102. Spring arms 124 can be provided in the second main wall 110 and the sidewalls 112 for gripping the mating connector 102 when received in the connector inner area 114. Shell 106 is preferably made of a thin metal material.

Figure 5:
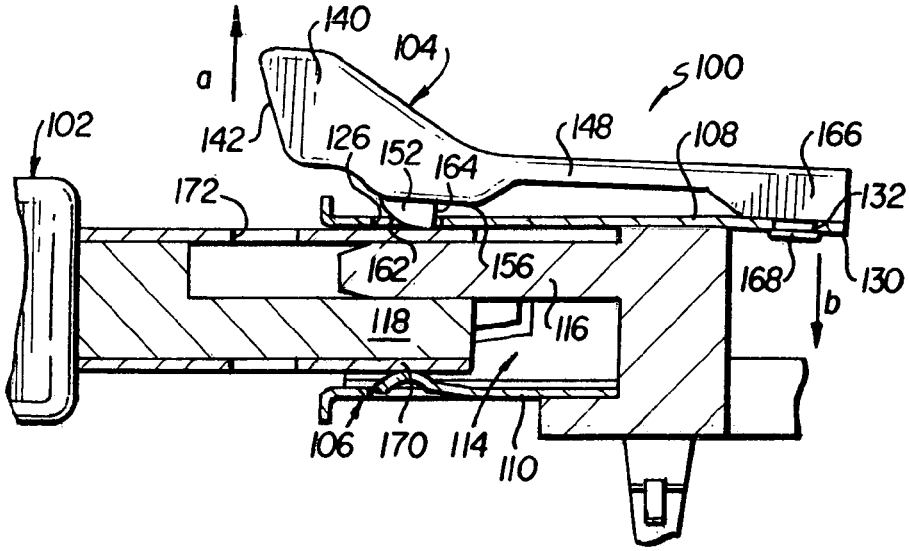
FIG. 5 is a partial elevational view in section of the electrical connector illustrated in FIGS. 1 and 2, showing the mating connector being inserted in to the connector.
Figure 6:
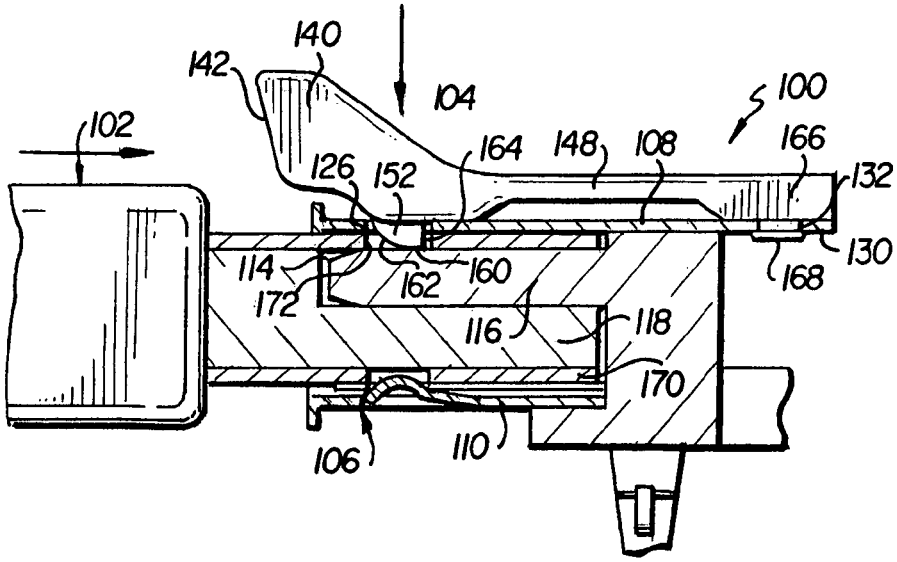
FIG. 6 is a partial elevational view in section of the electrical connector illustrated in FIG. 2, taken along line 6—6, showing the connectors fully mated and locked.

As seen in FIGS. 3, 5 and 6, the first main wall 108 of connector shell 106 includes first and second locking openings 126 and 128 located near the first end 120 of shell 106 and a flexible extension 130 extending in a cantilever manner from the second end 122 of shell 106. The locking openings 126 and 128 are spaced from one another and spaced from sidewalls 112 of shell 106. Extension 130 includes two holes 132 for mating with locking member 104. Extension 130 is made of thin metal allow the extension to flex and spring back to a cantilevered position from shell 106.

Figure 4:
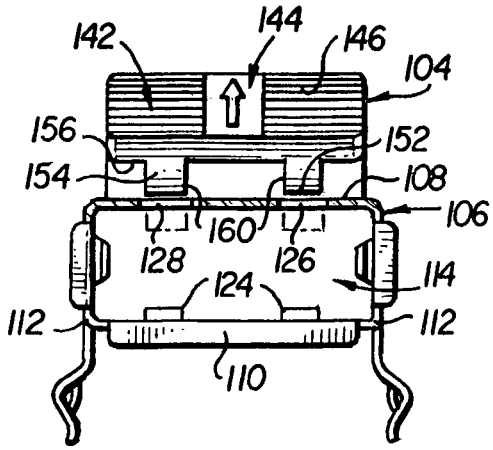
FIG. 4 is a front elevational view of the shell and a locking member of the electrical connector illustrated in FIGS. 1 and 2, showing the locking member in locked and unlocked positions.

Locking member 104 includes a main body 134 with first and second opposite ends 136 and 138. The first end 136 includes a head portion 140 with a gripping surface 142 on its face 144. Preferably, gripping surface 142 has a plurality of ridges 146, as best seen in FIG. 4. Locking member 104 is a one-piece member preferably made of a flexible and resilient plastic material. The middle section 148 of main body 134 between ends 136 and 138 can be substantially thinner than the ends 136 and 138 to increase flexibility of locking member 104. A weakened area or line 150 (FIGS. 1 and 2) can also be included across main body 134 near the second end 138 of locking member 104 to facilitate flexing of locking member 104. Alternatively, locking member 104 can be made of a rigid or semi-rigid material.

First and second locking tabs 152 and 154 extend from the bottom surface 156 of locking member 104 near head portion 140, as seen in FIGS. 4–6. First and second locking tabs 152 and 154 are received in first and second locking openings 126 and 128, respectively, of connector shell 106, with bottom portions 160 extending into the inner area 114 of connector 100 (FIG. 6). Each locking tab 152 and 154 includes a front curved surface 162 and a straight back surface 164, as seen in FIGS. 5 and 6.

The second end 138 of locking member 104 includes a tail portion 166 coupled to extension 130 of connector shell 106. As seen in FIGS. 5 and 6, pins 168 extending from tail portion 166 engage holes 132, preferably in an interference or press fit, to couple locking member 104 to shell 106. Although pins 168 are preferred, the tail portion 166 of locking member 104 can be coupled to extension 130 of shell 106 in any known manner, such as snap fitting, riveting, adhesive, and the like.

The spring nature of the metal extension 130 coupled to the tail portion 166 of locking member 104 biases locking member 104 toward shell 106 so that the bottom surface 156 of locking member 104 rests on first main wall 108 of shell 106 and locking tabs 152 and 154 are received in openings 126 and 128 when the locking member 104 is in its resting position. If locking member 104 is made of a flexible material, the resiliency of the locking member 104 will also assist in biasing the locking member 104 toward the shell 106.

To connect the connector 100 and its mating connector 102, a terminal end 170 of the mating connector 102 is slideably inserted into the inner area 114 of the connector 100 to engage their contacts 116 and 118. The mating connector 102 includes first and second locking openings 172 and 174 (FIG. 1) in a wall 176 of the terminal end 170 for engaging locking tabs 152 and 154 of locking member 104. As the terminal end 170 of mating connector 102 is inserted into inner area 114 of connector 100, terminal end 170 abuts front curved surfaces 162 of locking tabs 152 and 154. The curved surfaces 162 of locking tabs 152 and 154 allow the terminal end 170 to slide along and past tabs 152 and 154. As the terminal end 170 slides along the curved surfaces 162 of tabs 152 and 154, the terminal end 170 pushes the tabs 152 and 154 and the locking member 104 in a first direction "a" (FIG. 5) out of the inner area 114 of connector 100, as seen in FIG. 5. Because locking member 104 is made of a flexible material, locking member 104 and tabs 152 and 154 will move in the first direction "a" when the terminal end 170 of mating connector 102 is inserted into inner area 114 of connector 100 until tabs 152 and 154 clear the inner area 114. Substantially simultaneously, tail portion 166 of locking member 104 and extension 130 flex or move slightly in a second direction "b" (FIG. 5) opposite the first direction "a."

As seen in FIG. 6, the terminal end 170 of mating connector 102 continues to slide into inner area 114 of connector 100 until locking openings 172 and 174 of mating connector 102 align with locking openings 126 and 128 of connector 100 allowing locking tabs 152 and 154 to drop into locking openings 172 and 174 of mating connector 102. Because locking member 104 is biased toward shell 106 of connector 100, tabs 152 and 154 will drop into openings 172 and 174 as soon as openings 172 and 174 align with tabs 152 and 154 and openings 126 and 128, thereby positively locking the connectors 100 and 102 together and preventing accidental separation of the connectors 100 and 102.

To disconnect the connector 100 and the mating connector 102, locking member 104 is actuated in the first direction "a", thereby releasing locking tabs 152 and 154 from locking openings 172 and 174 of mating connector 102. Locking member 104 can be actuated by lifting locking member 104 using gripping surface 142 of locking member 104. Mating connector 102 can then be slideably removed from inner area 114 of connector 100. Once connectors 100 and 102 are separated, locking member 104 will drop back to its resting position on main wall 108 of connector shell 106 with tabs 152 and 154 received in openings 126 and 128.

While a particular embodiment has been chosen to illustrate the invention, it will be understood by those skilled in the art that various changes and modifications can be made therein without departing from the scope of the invention as defined in the appended claims. For example, any number of locking tabs 152 and 154 and corresponding locking openings 126, 128, 172, and 174 can be used including a single locking tab and single locking opening in each connector, or more than two locking tabs and more than two locking openings in each connector. In another example, the locking tabs 152 and 154 can be provided on the mating connector 102 and the corresponding locking openings 172 and 174 can be provided on the connector 100.

What is claimed is:

1. An electrical connector, comprising:

a shell having an inner area supporting a contact adapted to mate with a contact of another connector, said shell including a wall having at least one locking opening and an integral flexible extension; and a locking member with first and second ends, said first end including at least one locking tab received in said locking opening and extending into said inner area of said shell in a locked position, and said second end being coupled to said extension of said shell, with said second end of said locking member including pins press fit into corresponding holes of said extension of said shell to couple said locking member to said shell, whereby said locking member is moveable to an unlocked position in a first direction away from said wall of said shell and said extension is moveable in a second direction opposite said first direction, so that no portion of said locking tab extends into said inner area of said shell in said unlocked position.

2. An electrical connector according to claim 1, wherein said wall of said shell includes a second locking opening; and said first end of said locking member including a second locking tab received in said second locking opening.

3. An electrical connector according to claim 1, wherein a bottom surface of said locking member rests on said wall of said shell when said locking member is in the locked position; and said bottom surface of said locking member is spaced from said wall of said shell when said locking member is in the unlocked position.

4. An electrical connector according to claim 1, wherein said locking member includes a gripping surface at said first end to facilitate movement of said locking member in said first direction.

5. An electrical connector according to claim 1, wherein said locking member is biased to the locked position.

6. An electrical connector according to claim 1, wherein said second end of said locking member includes a weakened area to facilitate movement of said locking member in said first direction.

7. An electrical connector according to claim 1, wherein said locking member is flexible.

8. An electrical connector, comprising:

a shell having an inner area supporting a contact mateable with a contact of another connector, said shell including a wall having at least one locking opening and an integral flexible extension; and a locking member moveable between locked and unlocked positions and having first and second ends, said first end including at least one locking tab, and said second end being coupled to said extension of said shell, with said second end of said locking member including pins press fit into corresponding holes of said extension of said shell to couple said locking member to said shell, whereby in the locked position said locking tab is received in said locking opening of said shell and in a corresponding locking opening of the other connector, and said locking member is moveable to the unlocked position in a first direction away from said wall of said shell and said extension of said shell is moveable in a second direction opposite said first direction, so that no portion of said locking tab extends into said locking opening of said second connector.

9. An electrical connector according to claim 8, wherein a bottom surface of said locking member rests on said wall of said shell when said locking member is in the locked position; and said bottom surface of said locking member is spaced from said wall of said shell when said locking member is in the unlocked position.

10. An electrical connector according to claim 8, wherein said locking opening and said locking tab are axially aligned.

11. An electrical connector according to claim 8, wherein said locking member is flexible.

12. An electrical connector according to claim 8, wherein said shell includes a second locking opening; and said locking member includes a second locking tab receivable in said second locking opening of said shell and a second opening of the other connector.

13. An electrical connector according to claim 8, wherein said locking member includes a gripping surface at said first end to facilitate movement of said locking member in said first direction.

14. A method for mating first and second electrical connectors, the first electrical connector including a locking member having a locking tab received in an opening of a shell of the electrical connector and a flexible extension extending from the shell, comprising the steps of:

press fitting pins of the locking member into corresponding openings in the extension of the first connector to couple the locking member to the first connector slideably inserting a terminal end of the second connector into an inner area of the first connector;

engaging the terminal end of the second connector with the locking tab of the locking member of the first connector to move the locking tab in a first direction out of the inner area of the first connector and substantially simultaneously moving the flexible extension in a second direction opposite the first direction; and dropping the locking tab in an opening in the second connector that aligns with the opening of the first connector, thereby releaseably locking the first and second connectors together.

15. The method of claim 14 further comprising the step of:

moving the locking member in the first direction until the locking tab is no longer received in the opening of the second connector; and slideably remove the second connector from the inner area of the shell of the first connector.

16. The method according to claim 15, wherein the locking member includes a gripping surface to facilitate movement of the locking member in the first direction.

17. The method according to claim 14, wherein the locking member is made of plastic; and the shell of the first connector is made of thin metal.

18. An electrical connector, comprising:

a shell having an inner area supporting a contact adapted to mate with a contact of another connector, said shell including a wall having at least one locking opening and a flexible extension; and a locking member with first and second ends, said first end including at least one locking tab received in said locking opening and extending into said inner area of said shell in a locked position, and said second end being coupled to said extension of said shell, wherein said second end of said locking member includes pins press fit into corresponding holes of said extension of said shell to couple said locking member to said shell;

whereby said locking member is moveable to an unlocked position in a first direction away from said wall of said shell and said extension is moveable in a second direction opposite said first direction, so that no portion of said locking tab extends into said inner area of said shell in said unlocked position.

* * * * *

UNITED STATES PATENT AND TRADEMARK OFFICE

CERTIFICATE OF CORRECTION

PATENT NO. : 7,128,595 B2
APPLICATION NO. : 11/086378
DATED : October 31, 2006
INVENTOR(S) : Kamal S. Boutros It is certified that error appears in the above-identified patent and that said Letters Patent is hereby corrected as shown below:

Col. 3, line 11, after "metal" insert --to--.

Signed and Sealed this

Fifth Day of June, 2007

JON W. DUDAS
*Director of the United States Patent and Trademark Office*